US005433657A

United States Patent [19]

Bovone

[11] Patent Number: 5,433,657

[45] Date of Patent: Jul. 18, 1995

[54] DEVICE FOR FIXING AND MAINTAINING SHAPEABLE GLASS PLATES IN POSITION DURING THEIR MACHINING

[76] Inventor: Luigi Bovone, Via Pernigotti 19, 15070 Belforte Monferrato (Allesandria), Italy

[21] Appl. No.: 101,917

[22] Filed: Aug. 4, 1993

[30] Foreign Application Priority Data

Sep. 21, 1992 [IT] Italy ..... MI92A2168

[51] Int. Cl.[6] ..... B75B 11/00

[52] U.S. Cl. ..... 451/388; 451/364; 269/21

[58] Field of Search ..... 51/233, 235, 216 P, 51/216 R; 269/20, 21; 451/388–395, 364, 391, 289

[56] References Cited

U.S. PATENT DOCUMENTS

| | | | |
|---|---|---|---|
| 4,656,791 | 4/1987 | Herrington | 269/21 |
| 4,805,887 | 2/1989 | Ray | 51/235 |
| 5,135,120 | 8/1992 | Given | 269/21 |
| 5,318,005 | 6/1994 | Mayer | 51/235 |

FOREIGN PATENT DOCUMENTS

| | | |
|---|---|---|
| 902515 | 11/1985 | Belgium . |
| 0175295 | 3/1986 | European Pat. Off. . |
| 0179957 | 5/1986 | European Pat. Off. . |
| 1286567 | 1/1962 | France . |
| 2205258 | 12/1988 | United Kingdom . |

*Primary Examiner*—Bruce M. Kisliuk
*Assistant Examiner*—Eileen P. Morgan
*Attorney, Agent, or Firm*—Steinberg, Raskin & Davidson

[57] ABSTRACT

A device for fixing and maintaining a shapeable glass plate (1) in position during its machining. The plate (1) is placed on a support surface (2) and preferably maintained spaced therefrom to allow a usual operating tool to move and act thereon, for example during a chamfering process. The device includes a plurality of suckers (11) associated with at least two mutually independent support elements (3, 3A, 3B) interposed between the plate and the support surface, the suckers (11) being associated with opposing faces (9, 10) of each element (3, 3A, 3B) so as to cooperate with the plate (1) and surface (2) respectively, the elements being constrained directly to each other but movable relative to each other and including air passage conduits (15, 16, 20, 55, 56) which, by drawing air from one element to another by suction applied to an opening (17, 18) at which at least one of the conduits opens to the outside of one of the elements, removes air from all the suckers (11) to constrain them to the plate (1) and support surface (2), so fixing these latter together.

18 Claims, 2 Drawing Sheets

DEVICE FOR FIXING AND MAINTAINING SHAPEABLE GLASS PLATES IN POSITION DURING THEIR MACHINING

BACKGROUND OF THE INVENTION

This invention relates to a device for fixing and maintaining a shapeable glass plate in position during its machining, the plate being placed on a support surface and preferably maintained spaced therefrom to allow a conventional operating tool to move and operate thereon, for example during a chamfering process.

During the machining of a glass plate, for example during the chamfering of such a plate, it is necessary to maintain the plate fixed to the support surface to allow the machining to be carried out uniformly along the entire perimetral edge of the glass.

It is known to use sucker devices to fix the plate to the support surface. These devices generally comprise a plurality of suckers connected together in series or parallel by hoses. The plate is fixed to the support surface by drawing air from the suckers through these hoses, as required.

This method has however various drawbacks. In particular, if the shape of the plate to be machined is very complex and non-geometrical, a very large number of suckers have to be used to achieve this fixing to the support surface. This means that the feed circuits become very complicated, with a large number of connection hoses between the suckers, these hoses often hindering the movement of the operating tool which machines the plate. Because of the large number of suckers their installation between the plate and support surface requires a considerable time, hence negatively affecting the cost of the process to which the glass plate is subjected.

However, if the shape of the plate is particularly complex and far removed from usual geometrical shapes, the known devices are unable to adequately retain the plate at its edges, i.e., they are unable to faithfully follow its contour. The result is imperfect machining of the glass, for example with regard to the inclination of the chamfer and to the chamfering path.

OBJECTS AND SUMMARY OF THE INVENTION

An object of the present invention is to provide a device which enables a glass plate associated with a support surface to be retained reliably and stably during its machining so that this can be performed under optimum conditions.

A particular object of the invention is to provide a device which provides stable and reliable fixing between the plate and support surface independently of the shape of the plate and without using a large number of sucker members.

A further object is to provide a device which acts on the plate in proximity to its peripheral edge so allowing optimum machining to be performed, for example with regard to the inclination of the chamber and to the chamfering path.

A further object is to provide a device which is very versatile in use and enables the plate to be fixed to the support surface within a short time.

These and further objects which will be apparent to the expert of the art are attained by a device of the stated type as described in the characterising part of the main claim.

BRIEF DESCRIPTION OF THE DRAWINGS

The present invention will be more apparent from the accompanying drawing, which is provided by way of non-limiting example and in which.

DETAILED DESCRIPTION OF THE INVENTION

Figure 1:
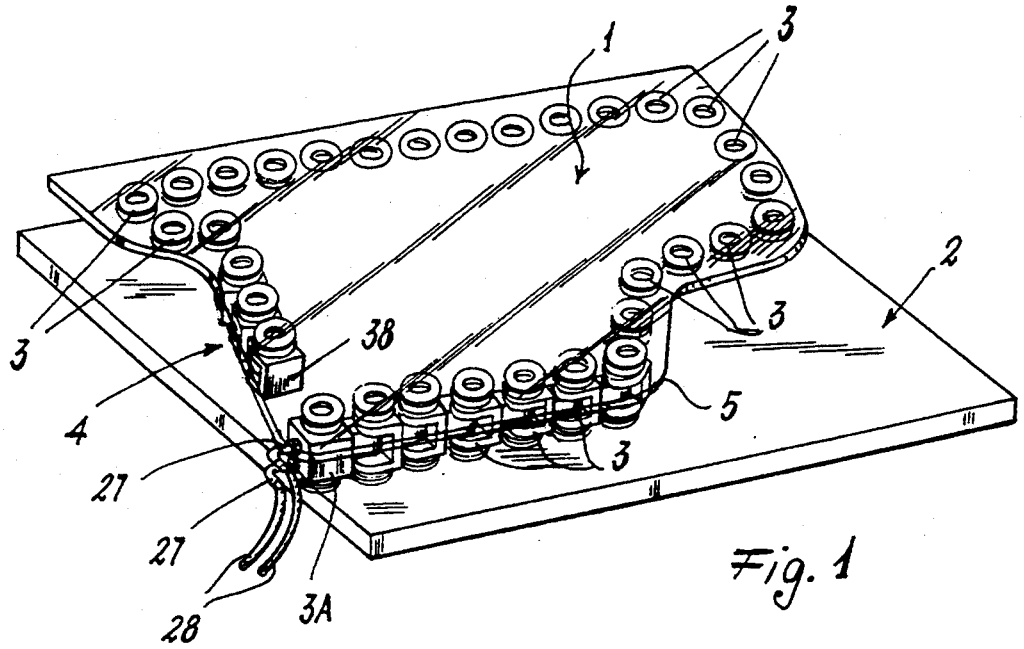
FIG. 1 is a perspective view of a device according to the invention during its application for fixing a glass plate to a support surface.

With reference to the figures, a glass plate 1 to be machined, for example chamfered, is placed on a support or working surface 2. The plate 1 is fixed to this latter by the device of the invention.

This device comprises a plurality of elements 3 hinged together to form a chain to be arranged as close as possible (consistent with the requirements of the machining process to which the plate is subjected) to the plate edge 5. Specifically, this chain comprises a head element 3A and a tail element 3B to which the elements 3 are connected, each of the elements (3, 3A, 3B) comprising a body 8 with two opposing faces 9 and 10 at which suckers or suction cups 11 are provided to cooperate with the surface 2 and plate 1 respectively.

Figure 2:
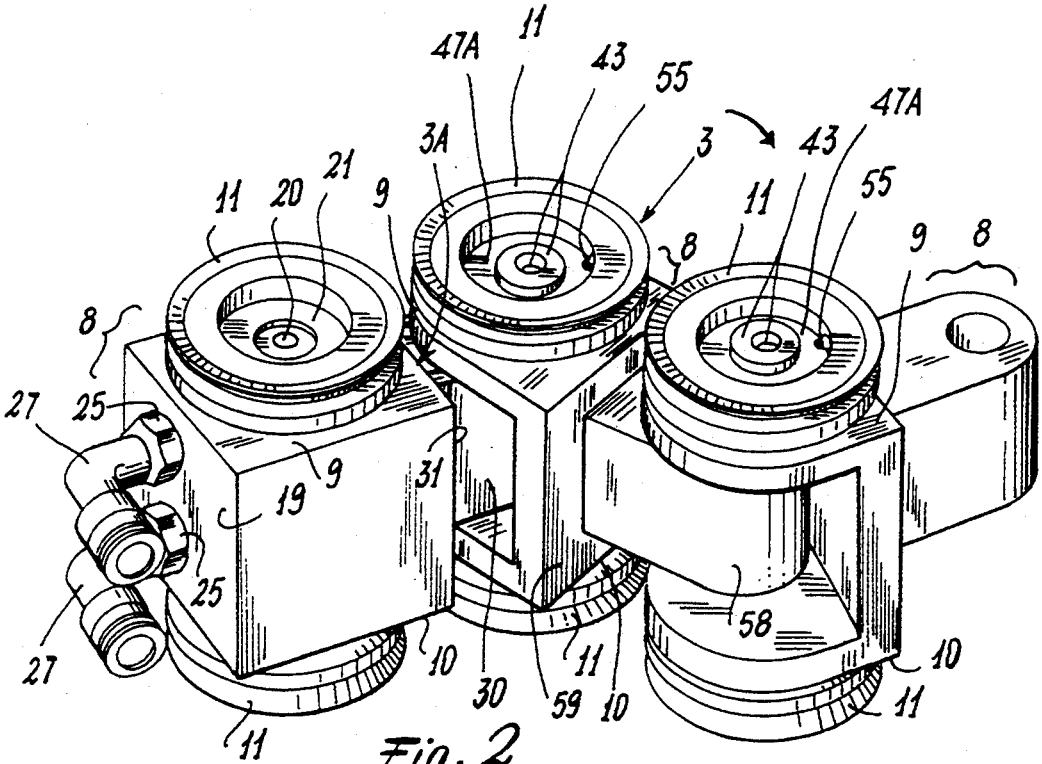
FIG. 2 is an enlarged perspective view of part of the device of FIG. 1.

More specifically (see FIG. 2 which shows a portion of the chain 4 of FIG. 1, and FIG. 3 which shows a chain 4 of smaller dimensions that that shown in FIG. 1) the head element 3A comprises channels 15 and 16 opening at 17 and 18 into a face 19 which connects together faces 9 and 10; each channel 15 and 16 is connected to a duct 20 opening into a recess 21 provided in a portion 22 about which a sucker 11 is positioned. At each opening 17 or 18 of each channel 15 and 16 there is provided within the body 8 of the element 3A a cavity 23 of enlarged cross-section and preferably with its wall 24 threaded, with which there can cooperate a corresponding known threaded insert 25 (see FIG. 2) connected to a respective pipe 27 (or pneumatic connection member) to be connected in any known manner to a usual hose 28 (see FIG. 1) connected to a known vacuum generator (not shown).

The body 8 of the element 3A under examination comprises a projection 30 extending from that face 31 opposite face 19. In this projection there is a through hole 32 housing a pin 33 which projects from the hole at its opposing ends 34. These ends are inserted into coaxial holes 35 provided in parallel opposing arms 36 of the body of an element 3, this element being hence associated with the head element 3A via the pin 33.

The channels 15 and 16 of this head element 3A reach the hole 32, so connecting it to the openings 17 and 18 and consequently to the hoses 28 connected to the vacuum generator.

As states, the pin 33 constrains the element 3A to the element 3, which is hence hinged to the former about the pin. The outer lateral surface of this latter comprises a plurality of annular grooves 39 containing seal elements 40, for example O-rings. The pin 33 internally comprises first ducts 41 and 42 arranged to cooperate with the channels 15 and 16 respectively and positioned axially to them, and second ducts 43 and 44 which are perpendicular to the first ducts 41 and 42 and extend from them to open at opposite ends 45 and 46 of the pin 33; these second ducts each open into a recess 47 provided in a portion 48 of the face 9 and 10 of the element 3 about which a corresponding sucker 11 is positioned.

The first ducts 41 and 42 are closed at one end by usual plugs 49.

The pin 33 is secured to the element 3 by at least one known locking member 50 (such as a split ring) inserted into an annular groove 51 provided in a pin portion lying within the recess 47.

From the base 47A of each recess 47 there extends a duct 55 terminating in a corresponding channel 56, 57 provided in a portion 58 extending from that face 59 of the body 8 of the element 3 which connects together the faces 9 and 10 of the body. In this portion there is provided a through hole 60 carrying a pin 61 identical to the pin 33 and hence not further described. In a manner identical to that already described, by means of this pin a further element 3 identical to the already described element 3 is connected to this latter. In this manner a plurality of elements 3 are associated with each other to form the chain 4.

Figure 3:
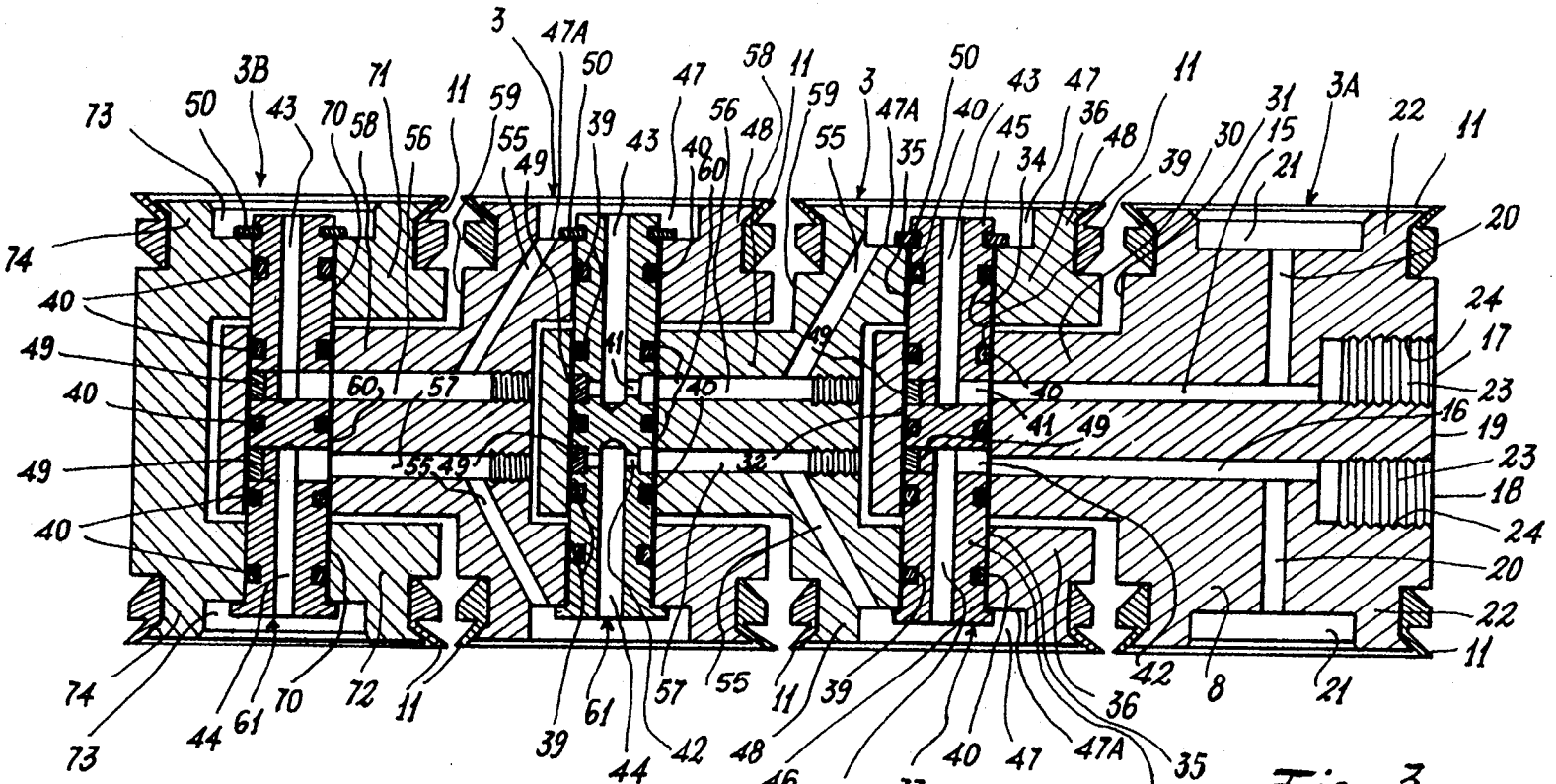
FIG. 3 is a cross-section through a different embodiment of the device of FIG. 1.

At the termination of the chain or chain portion 4 (as shown in FIG. 3), the element 3 is connected to the tail element 3B by means of a pin (again indicated by 61 in FIG. 3) identical to the described pin 33. The opposing ends 34 of this pin are inserted into through holes 70 provided in parallel overlying arms 71 and 72 of the body 8 of the element 3B, the pin being secured to this element 3B by rings 50 as already described.

Specifically, the element 3B comprises a substantially C-shaped body without internal channels. In this respect, the ducts 43 and 44 of the pin 61 connect recesses 73, provided in portions 74 about which the suckers 11 are positioned, to the ducts 56 and 57 of the element 3 with which the element 3B is associated. In this manner the suckers 11 of the tail element are able to operate on the plate 1 and on the surface 2 in the same manner as the suckers of every other component of the chain 4.

It will now be assumed that a glass plate 1 is to be fixed to the surface 2 to enable it to be machined, for example chamfered.

To achieve this, the chain 4 of elements 3, 3A and 3B is firstly arranged on the surface 2 below the plate 1, positioning the elements as close as possible to the edge 5 of said plate, for example to prevent any bending forces arising on the plate while a usual chamfering tool is operating on it.

Having done this and connected the hoses 28 to the vacuum generator, air is drawn from the channels 15 and 16 of the head element 3A, hence causing all the suckers 11 of the chain 4 to adhere to the plate 1 and surface 2, so fixing these latter together.

More specifically, analyzing the adhesion of the suckers 11 to the plate 1 (the suckers 11 adhere to the surface 2 in an identical manner), the vacuum generator draws air from the channel 15 and duct 20 of the body 8 of the element 3A. Likewise, air is drawn from the first duct 41 and second duct 43 of the pin 33 of the (intermediate) element 3 associated with the head element 3A; in this manner air is drawn from the recess 47 of the portion 48 of this element about which the sucker 11 is positioned to cooperate with the plate 1. This sucker adheres to the glass. The same occurs in every other element 3 of the chain.

With reference to FIG. 3, the sequence in which air is drawn from the suckers of the elements 3 and 3B connected to the aforesaid element 3 is as follows: because of the connection between the recess 73 of the tail element 3B and the recess 47 of the element connected to the head element 3A via the duct 55, the channel 56 of this element 3, the ducts 41 and 43 of the pin 61 connecting together the two similar elements 3, the channels and ducts 55 and 56 of the element associated with the tail element 3B and the ducts of the pin 61 which connect the elements 3 and 3B together, the air present in the recess 73 of this latter passes through the pin 61 connecting the elements 3B and 3 together, and through the elements 3, to be then drawn through the hose 28 connected to the head element 3A. In this manner vacuum is applied to each sucker cooperating with the plate 1 and likewise to the suckers cooperating with the surface 2. Hence the plate and surface are fixed together but spaced apart by an extent sufficient to allow the chamfering tool to operate without problems.

The parts are released by allowing air to penetrate into the ducts and channels in known manner.

The chain 4 can be made of the required size by varying the number of elements 3 connected between the head and tail elements. A plate 1 can obviously be fixed to the surface 2 by using a plurality of pairs of elements 3A and 3B alone, connected to one or more vacuum generators.

One embodiment of the invention has been described. Other embodiments are possible which fall within the scope of the present document.

I claim:

1. A device for fixing and maintaining a glass plate in position during machining supported by, and at a distance from, a support surface to allow a machining tool to operate on the plate, comprising a plurality of support elements having first and second opposed faces, said first face being oriented toward the plate and said second face being oriented toward the support surface, said support elements comprising air passage conduits, at least one of said support elements being a head element connectable to a vacuum source, a suction cup arranged on each of said first and second opposed faces of said support elements to engage with the plate and the support surface, respectively, said suction cups communicating with said air passage conduits in each of said support elements, and connecting means coupled to said support elements for movably connecting said support elements to each other to form a flexible chain, said connecting means connecting adjacent ones of said support elements in said chain to each other such that said air passage conduits in said support elements are coupled together.

2. The device of claim 1, wherein said connecting means comprise pins for mechanically connecting adjacent ones of said support elements in said chain to each other, said pins having ducts therein for pneumatically coupling said air passage conduits in said support elements together.

3. The device of claim 1, wherein said head element comprises a body portion having a lateral face extending between said first and second opposed faces, channels opening into said lateral face of said body, and ducts for connecting a respective one of said channels to a respective one of said suction cups on said first and second opposed faces of said head element.

4. The device of claim 1, wherein said plurality of support elements comprises a tail element having a substantially C-shaped body portion formed by overlying parallel arms, said arms having coaxial through-holes opening into said first and second opposed faces of said tail element and communicating with respective ones of said suction cups on said first and second opposed faces of said tail element.

5. The device of claim 1, wherein said plurality of support elements comprises at least three of said support elements, said at least three support elements comprising said head element, a tail element, and at least one intermediate element positioned between said head element and said tail element.

6. The device of claim 5, wherein said tail element has a substantially C-shaped body portion formed by overlying parallel arms, said arms having coaxial through-holes opening into said first and second opposed faces of said tail element and communicating with respective ones of said suction cups on said first and second opposed faces of said tail element, said at least one intermediate element comprising a body portion including a projecting part insertable between said arms of said tail element, said projecting part comprising a through-hole coaxially positionable relative to said through-holes in said arms of said tail element to define a seat for said connecting means which connect said tail element to said at least one intermediate element.

7. The device of claim 1, wherein said connecting means comprises a respective pin provided with ducts arranged to couple said air passage conduits of adjacent, connected ones of said support elements.

8. The device of claim 7, wherein said connecting means includes a body having an outer lateral, peripheral surface comprising a plurality of annular recesses, and the device further comprises seal elements housed in said annular recesses of said body of said connecting means.

9. The device of claim 7, wherein each of said pins comprises a first duct and a second duct arranged at an angle to each other, said second duct being operationally coupled to a respective one of said suction cups on one of said support elements and said first duct opening into an outer lateral, peripheral surface of said pin to cooperate with said air passage conduits of an adjacent one of said support elements connected to said one of said support elements.

10. The device of claim 5, wherein one of said at least one intermediate element comprises arms and is connected to said head element, said head element further comprising a projecting portion having through-holes and being insertable between said arms of said intermediate element connected thereto, said through-holes of said projecting portion being receivable of said connecting means.

11. The device of claim 3, further comprising pneumatic connection members engageable with said channels of said head element for connecting said head element to the vacuum source.

12. The device of claim 5, wherein said intermediate element is connected to said head element and to said tail element, said head element further comprises a projecting portion having through-holes, said intermediate element comprising a projecting portion having through-holes and having overlying parallel arms for receiving said projecting portion of said head element, said tail element having overlying parallel arms for receiving said projecting portion of said intermediate element, said arms and projecting portion of said intermediate element comprising through-holes for receiving said connecting means, said through-holes of said arms communicating with respective ones of said suction cups on said first and second opposed faces of said intermediate element.

13. The device of claim 12, wherein said intermediate element further comprises channels and ducts connected via said channels to said respective suction cups of said intermediate element, said ducts opening into said through-hole of said projecting portion of said intermediate element.

14. The device of claim 1, further comprising at least four of said support elements, said at least four support elements comprising a tail element, said head element and at least two intermediate elements arranged successively between said tail element and said head element such that a first one of said intermediate elements is connected to said head element by said connecting means and a second one of said intermediate elements is connected to said tail element by said connecting means, said at least two intermediate elements being coupled together by said connecting means to define a continuous chain.

15. The device of claim 14, wherein said connecting means comprises a hinge for connecting adjacent ones of said support elements to each other.

16. The device of claim 1, further comprising locking means for securing said connecting means to said support elements.

17. The device of claim 1, wherein air drawn from said head element by the vacuum source to apply suction through said air passage conduits in said support elements and to said suction cups to maintain the plate in a fixed position relative to the support surface.

18. A device for fixing a plate of glass plate on support of a support surface, comprising a plurality of support elements having first and second opposed sides facing toward the plate and toward the support surface, respectively, said support elements comprising air passage conduits, at least one of said support elements being a head element connectable to a vacuum source, suction means arranged on said first and second opposed sides of said support elements for engaging with the plate of glass and the support surface, respectively, said suction means communicating with said air passage conduits, and connecting means coupled to said support elements for movably connecting said support elements to each other to form a flexible chain, said connecting means connecting adjacent ones of said support elements in said chain to each other such that said air passage conduits in said support elements are coupled together and air drawn from said head element by the vacuum source applies suction through said air passage conduits in said support elements and to said suction means to maintain the plate of glass in a fixed position relative to the support surface.

* * * * *